United States Patent [19]

Kobayashi et al.

[11] Patent Number: 4,522,881

[45] Date of Patent: Jun. 11, 1985

[54] COVER FILM FOR COLOR HARD COPY PRINTING PAPER

[75] Inventors: Naotake Kobayashi; Tetsuya Abe; Yoshio Fujiwara, all of Utsunomiya, Japan

[73] Assignee: Sony Corporation, Tokyo, Japan

[21] Appl. No.: 552,037

[22] PCT Filed: Mar. 1, 1983

[86] PCT No.: PCT/JP83/00064

§ 371 Date: Oct. 31, 1983

§ 102(e) Date: Oct. 31, 1983

[87] PCT Pub. No.: WO83/03080

PCT Pub. Date: Sep. 15, 1983

[30] Foreign Application Priority Data

Mar. 2, 1982 [JP] Japan ..... 57-32612

[51] Int. Cl.[3] ..... B41M 5/26

[52] U.S. Cl. ..... 428/336; 8/471; 428/480; 428/481; 428/514; 428/522; 428/537.5; 428/913; 428/914; 430/961

[58] Field of Search ..... 8/470, 471, 506, 509, 8/512, 685; 428/207, 412, 913, 914, 336, 480, 481, 511, 514, 522, 537.5; 430/961

[56] References Cited

U.S. PATENT DOCUMENTS

| | | | |
|---|---|---|---|
| 2,777,828 | 1/1957 | Day | 260/45.4 |
| 2,824,080 | 2/1958 | Haux | 260/45.4 |
| 3,309,220 | 3/1967 | Osteen | 117/33.3 |
| 4,253,838 | 3/1981 | Mizuno et al. | 8/471 |
| 4,271,224 | 6/1981 | Mizuno et al. | 428/207 |
| 4,272,292 | 6/1981 | Mizuno | 106/22 |
| 4,362,529 | 12/1982 | Mizuno et al. | 8/471 |
| 4,367,071 | 1/1983 | Mizuno et al. | 8/471 |
| 4,424,691 | 1/1984 | Mizuno et al. | 156/234 |
| 4,472,491 | 9/1984 | Wiedemann | 430/961 |

FOREIGN PATENT DOCUMENTS

| | | | |
|---|---|---|---|
| 46-35240 | 10/1971 | Japan | 428/914 |
| 47-23003 | 11/1972 | Japan | 428/914 |
| 47-46207 | 11/1972 | Japan | 428/914 |
| 57-34994 | 2/1982 | Japan | 428/914 |
| 58-20491 | 2/1983 | Japan | 428/914 |

*Primary Examiner*—Bruce H. Hess

*Attorney, Agent, or Firm*—Hill, Van Santen, Steadman & Simpson

[57] ABSTRACT

The present invention relates to a cover film for a color hard copy printing paper by which a colorless and transparent protective layer can be formed on a surface of a printing paper on which a color-print is made. The cover film for a color hard copy printing paper according to the present invention comprises a heat-resistant base and a cover material layer including a colorless and transparent ultraviolet ray shielding layer which is formed on the heat-resistant base, has no adhesive property for the heat-resistant base and is melted and transferred to a surface of a printing paper by heating. According to the cover film for a color hard copy printing paper, it is possible to form with ease a protective layer having small curl and high color fading protection property on a surface of a color-copied printing paper.

6 Claims, 4 Drawing Figures

COVER FILM FOR COLOR HARD COPY PRINTING PAPER

TECHNICAL FIELD

The present invention relates to a transferable cover film to a color hard copy printing paper by which a colorless and transparent protective layer can be easily formed on the surface of a printing paper on which a color print is made.

BACKGROUND ART

It is possible that a dye carrier paper formed by coating thereon an ink containing a sublimation dye is heated by a thermal print head and then the dye of a necessary portion is selectively transferred to make a color picture on a printing paper. The picture thus formed has, however, the following problems. Since the dye thus transferred is adsorbed on the surface of the printing paper but not diffused well, a part thereof remains as aggregation substance and hence it does not present its inherent color. Therefore, after printing, the printing paper has to be heated again to thereby perform the thermal diffusion of the dye into the printing paper. Moreover, there is such a defect that the dye thus transferred is apt to be faded by, for example, oil and others soaked thereto from hands and also is easily faded by ultraviolet rays contained in natural light. To overcome these defects, it was considered that a protective film made of polyester film or the like with a thin heat melting layer bonded on its one surface was attached to the printing paper by heating. However, in the color copy having the protective film formed thereon, since its protective film is expanded and/or shrinked by heat generated upon bonding, the product thereof is considerably curled and also the fading preventing effect of the dye is not sufficient. The result of investigation reveals that in order to provide the protective layer resulting in a small curl when provided with the printing paper, it is preferred that the thickness of the resin layer is selected to be lower than 20 μm. If the protective layer has the thickness larger than the above value, the curl becomes large and the commercial value is lowered greatly. Moreover, in order to form the uniform protective layer well, a resin layer having a thickness of at least 1 μm is necessary. There is, however, a great deal of difficulty that such thin film is bonded by heating to the color copy without being wrinkled.

DISCLOSURE OF INVENTION

The present invention is to provide a cover film for a color hard copy printing paper which can solve the above problems.

The present invention is to provide a cover film for a color hard copy printing paper by which a protective layer avoiding a color fading property and having a less curl can be formed on a surface of a color copy transferred and dyed on a printing paper from a dye carrier paper made by using sublimation dye, by thermally pressing a thin transparent resin film, which does not pass therethrough ultraviolet rays, from a base material having thickness and strength for easy handling. According to the present invention, the cover film is formed of a heat-resistant base material and a colorless and transparent cover material layer, having no adhesive property to the base material, containing a layer preventing the ultraviolet rays and being molten and then transferred to the surface of a printing paper by heating, which is formed on the base material.

FIGS. 1 to 4 are diagrams each showing the structure of a transferable cover film according to the present invention. In the figures, reference character (A) designates a plastic film base material exemplified by polyester, polycarbonate, polyacrylate or the like whose surface is smoothed or subjected to crape treatment and releasing treatment, if necessary and which has relatively heat-resistant property. A base (D) is such a base having a higher smoothness formed by superposing the same film as above on one surface of a paper (D') or coating thereon a cross-linking resin having heat-resistant property (for example, silicone resin, unsaturated polyester resin and so on) (D''). The thickness of the bases (A) and (D) is preferably selected to be less than 100 μm. This value is selected in view of the easy handling, duration of time necessary for a hot press and so on. A cover material (B) is a colorless and transparent thermoplastic resin layer which is not adhered by melt to the base but melted and bonded to the printing paper and which does not allow the ultraviolet rays to pass therethrough. A cover material (C) is formed of two layers in which one layer close to the base is a resin layer (C') composed mainly of a colorless and transparent cross-linking heat-resistant resin layer (such as cross-linking urethane resin, cross-linking polyester resin and so on) which is not adhered by melt to the base or resin such as acetate resin which inherently does not allow the passage of the ultraviolet rays, while the other layer is a colorless and transparent layer (C'') which has adhesive property to the printing paper and the upper layer (C'). The thickness of the cover material is selected to be in a range from 1 to 20μ, more preferably in a range from 5 to 10μ. In order to avoid the ultraviolet rays, it is desired that ultraviolet ray absorbent of a predetermined amount is added to the cover material. Since almost all of the sublimation dye is a dispersion dye, in order to raise the dyeing property of the dye, the surface of the printing paper is treated with a resin having high dyeing property such as polyester, epoxy, nylon and so on. For this reason, it is necessary to select the resin forming the cover material (B) or (C'') which resin can be melted and bonded to the above treated resin. As far as the resins allow the melting and bonding to the surface of the printing paper, the kind of the resin is not limited particularly. The surface of the base material may be subjected to a silicone or fluorine resin releasing treatment in order to facilitate the peeling-off from the cover material. The shielding for the ultraviolet rays may be performed by the use of a resin material through which the ultraviolet rays are inherently difficult to pass, or the ultraviolet ray absorbent contained in the cover material. The ultraviolet ray absorbent may be benzotriazole type or salicylic acid derivative and so on in addition to benzophenon type such as hydroxy benzophenon, dihydroxy benzophenon and so on.

Since the base has the thickness and strength which allow the easy handling, the cover material can be a transferrable cover film which can be easily worked to become a protection layer having the thickness of 1 to 20μ, less curl and a high color fading protection property on the surface of the color copy which is formed by the dyeing of the sublimation dye upon heating and pressing from the side of the base.

BEST MODE FOR CARRYING OUT THE INVENTION

Figure 1:
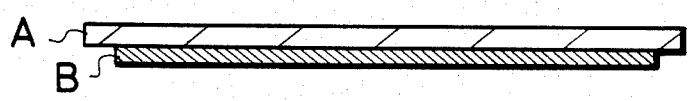
FIGS. 1 to 4 are respectively cross-sectional views illustrating cover films according to the present invention.
Figure 2:
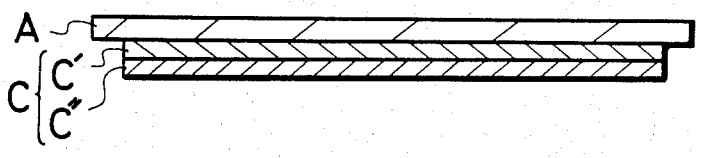
Figure 3:
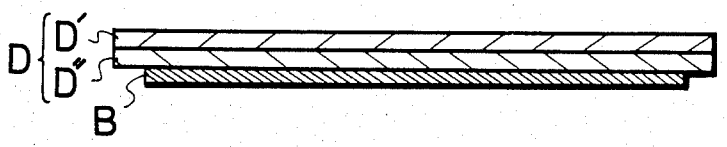
Figure 4:
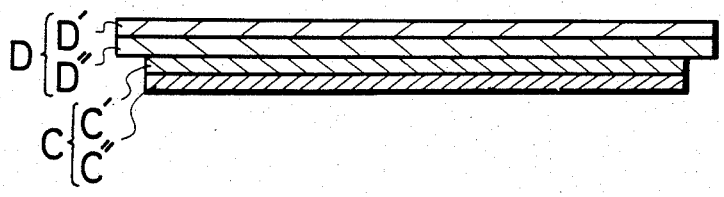

Next, embodiments of the present invention will be described.

Comparative example 1

A coating composition formed of 24 parts by weight of internally plasticized saturated polyester resin (VILON #200, manufactured by Toyobo Co., Ltd.), 6 parts by weight of ultra fine particle silica (NIPSIL E220A, manufactured by Nippon Silica Industrial Co., Ltd.) and 70 parts by weight of methyl ethyl ketone solvent was coated on one surface of a best quality paper having the area weight of 170 g/M$^2$, so as to have a dried coating amount of approximately 5 g/M$^2$, thus a printing paper for hard copy, which is subjected to thermal transfer of sublimation dye was prepared. On the other hand, a dye carrier paper for magenta color was prepared by gravure coating an ink composed of 6 parts by weight of anthraquinone type dispersion dye for magenta color (PTR 63, manufactured by Mitsubishi Chemical Industries Ltd.), 6 parts by weight of ethylcellulose and 88 parts by weight of isopropyl alcohol on a surface of a paper having an area weight of 40 g/M$^2$ with a coating amount of 5 g/M$^2$ after dryed. Similarly, cyan color ink, yellow color ink and black color ink were coated on a paper, thus dye carrier papers of 4 colors were prepared. Then one of the printing paper and the dye carrier paper were superposed with each other and thermal energy was given from the back side of the dye carrier paper by a thermal print head having a temperature of about 300° C., thus transfer the dye to the printing paper. The other 3 colors were also transferred similarly one after another, thus a color print was made on the printing paper.

Meanwhile, a cover film was made by coating polyester resin having a heat melting and bonding property up to about 2μ thick on a surface of a polyester film base having a thickness of 30μ and then pressed on the color print by the use of a hot plate of about 150° C.

Comparative example 2

A cover film was made by coating polyester resin having heat melting and bonding property up to about 2μ thick on a surface of a polyester film base of 12μ thick and then pressed on the color print in the same way as in the comparative example 1.

Example 1

A cover film made by coating resinuous liquid, which was made by dissolving and mixing ultraviolet ray absorbent (Tinuvin P, manufactured by CIBA-GEIGY A.G.) by 0.2 weight % for the resin into internally plasticized saturated polyester resin (VILON #200, manufactured by Toyobo Co., Ltd.), on a surface of polyester film base having a thickness of 25μ one surface of which was subjected to a releasing treatment by a silicone releasing agent so as to have a thickness of 10μ after being dried was similarly pressed on the color print as in the comparative example 1 and then only the polyester film is peeled off.

Example 2

A first layer having a thickness of 10μ and composed of same amount of cellulose acetate propionate and solid epoxy resin was formed on a matte-treated surface of a polyester film base having a thickness of 30μ. Then, a second layer of 5μ thick formed of equal amount of solid epoxy resin and internally plasticized polyester resin which contain 0.2 weight % of ultraviolet absorbent for the resin was formed to form a cover film which then was pressed on the color print in the same way as in the comparative example 1. After that, only the matte film was peeled off and thus a color print having the matte shape cover was obtained.

The cellulose acetate propionate used in this example has ultraviolet ray absorbing effect and does not have an adhesive property for the polyester film which is used as the base material. Since the second layer material is the internally plasticized polyester having an adhesive property for the epoxy resin contained in the first layer and for the printing paper, it is bonded upon heating to the first layer and the printing paper.

Example 3

On a polyester film with the thickness of 25μ a first layer having a thickness of about 10μ and made of cellulose acetate butylate resin was coated and thereon a second layer with the thickness of about 5μ was formed which was made of equal amount of cellulose acetate butylate and solid epoxy resin to thereby form a cover film. On the other hand, a printing paper was formed which was coated with coating composition composed from dispersing ultra fine particle silica (NIPSIL E220A, manufactured by Nippon Silica Industrial Co., Ltd.) by 20 weight % for the resin into resinuous liquid having the same mixing ratio as that of the second layer. Then, the above cover film was pressed on the color print which was printed by the dye carrier papers used in the comparative example 1. After that, only the polyester film was peeled off and thus a protective layer which has a high transparency and which per se can avoid the ultraviolet rays was formed on the color print. The cellulose acetate butylate used in the first layer is not bonded upon heating to the base material made of polyester resin as described in the example 2. And, the second layer is made of cellulose acetate butylate and epoxy resin so as to be bonded to the first layer and the layer made of the same material as that of the second layer is formed on the surface of the printing paper which is bonded with the second layer so that the second layer is bonded to the surface of the printing paper satisfactorily.

Example 4

A coating composition made of 70 parts by weight of acryl modified epoxy oligomer (SP4010, manufactured by Showa Highpolymer Co., Ltd.), 30 parts by weight of diluent tetrahydrofurfuryl acrylate, 3 parts by weight of photopolymerization initiator (IRGACURE 651, manufactured by CIBA-GEIGY A.G.) and 0.5 parts by weight of thermal-polymerization inhibitor 2-ethyl anthraquinone was coated on one surface of a best quality paper having the area weight of 170 g/M$^2$ and then hardened by the irradiation of ultraviolet rays, thus providing a base material having a high surface smoothness. A resinuous layer having a thickness of 10μ which was made of equal amount of triacetate resin and solid epoxy resin to which 0.2 weight % of an ultraviolet ray absorbent relative to the resin was dissolved was formed on the treated surface and then pressed on the printing paper formed in the example 3. After that, only the base material formed on the treatment paper was removed.

Example 5

A cover film was formed in such a manner that a cellulose acetate butylate resin with a thickness of 5μ was formed on a polyester film having a thickness of 30μ which was subjected to the releasing treatment. After this cover film was pressed on the printing paper which was formed in the example 3, only the polyester film was peeled off and thus a cover having a small curl and a large color fading protection property was formed on the color print.

A table 1 shows measured results of the state of curl of the color prints each having the protective layer formed as described above, workability thereof upon pressing and tenebrescene of dye on the color print when it was exposed to the ultraviolet rays for 100 hours.

TABLE 1

| experiment number | state of curl | workability | tenebrescence |
|---|---|---|---|
| comparative example 1 | severely curled | satisfactory | almost all colors are faded |
| comparative example 2 | slightly curled | easy to wrinkle | almost all colors are faded |
| example 1 | slightly curled | satisfactory | only blue is faded a little |
| example 2 | slightly curled | satisfactory | not faded substantially |
| example 3 | slightly curled | satisfactory | not faded substantially |
| example 4 | slightly curled | satisfactory | not faded substantially |
| example 5 | not curled substantially | satisfactory | not faded substantially |

As will be clear from the measured results shown in the table 1, since the cover film according to the present invention is the base material which is easy to handle, it never occurs that it is wrinkled. Since the protective layer practically formed on the color print is only the thin film having a thickness of 1 to 20μ which can prevent the ultraviolet rays to pass therethrough, it is possible to form the transparent protective layer which causes almost no curl and which has a large color fading protection property of dye

We claim:

1. A cover film for a color hard copy printing paper comprising a heat-resistant base and a cover material layer including a colorless and transparent ultraviolet ray shielding layer which is formed on said heat-resistant base and has no adhesive property upon heating for said heat-resistant base and is capable of being melted and bonded to a surface of a printing paper by heating.

2. A cover film for a color hard copy printing paper comprising a heat-resistant base and a cover material layer including a colorless and transparent ultraviolet ray shielding layer which is formed on said heat-resistant base and has no adhesive property upon heating for said heat-resistant base and is capable of being melted and bonded by heating to a surface of a printing paper on which a color picture is formed by the transfer of sublimation dyes of at least three colors.

3. A cover film for a color hard copy printing paper according to claim 1 or 2, wherein said heat-resistant base is a heat resistant plastic film selected from polyester, polycarbonate and polyacrylate or a heat-resistant plastic film selected from polyester, polycarbonate and polyacrylate and formed on a surface of a paper.

4. A cover film for a color hard copy printing paper according to claim 1 or 2, wherein said cover material layer has a thickness of 1 to 20μ.

5. A cover film for a color hard copy printing paper according to claim 1 or 2, wherein a surface of said heat-resistant base is capable of a peeling-off treatment.

6. A cover film for a color hard copy printing paper according to claim 1 or 2, wherein said ultraviolet ray shielding layer has an ultraviolet ray absorbent selected from benzophenon system, benzotriazole system or salicylic acid derivative.

* * * * *